US006752884B2

(12) United States Patent
Min

(10) Patent No.: US 6,752,884 B2
(45) Date of Patent: Jun. 22, 2004

(54) METHOD FOR MANUFACTURING MESH SCREEN OF ELECTRODELESS LIGHTING SYSTEM

(75) Inventor: Byoung-Ok Min, Seoul (KR)

(73) Assignee: LG Electronics Inc. (KR)

( * ) Notice: Subject to any disclaimer, the term of this patent is extended or adjusted under 35 U.S.C. 154(b) by 7 days.

(21) Appl. No.: 10/119,403

(22) Filed: Apr. 8, 2002

(65) Prior Publication Data

US 2003/0098101 A1 May 29, 2003

(30) Foreign Application Priority Data

Nov. 23, 2001 (KR) ..... 2001-0073507
Feb. 22, 2002 (KR) ..... 2002-0009661

(51) Int. Cl.[7] ..... C22F 1/02

(52) U.S. Cl. ..... 148/518; 148/527; 205/181; 427/125

(58) Field of Search ..... 148/518, 527; 427/125; 205/170, 181

(56) References Cited

U.S. PATENT DOCUMENTS 4,708,888 A * 11/1987 Mitchell et al. ..... 427/126.1
5,031,290 A * 7/1991 Brereton et al. ..... 427/125
5,531,955 A * 7/1996 Sugikawa ..... 148/518
5,939,172 A * 8/1999 Snakenborg et al. ..... 148/518
6,238,545 B1 * 5/2001 Allenbach et al. ..... 205/734
6,264,766 B1 * 7/2001 Ritter et al. ..... 148/525
6,540,850 B2 * 4/2003 Saloka et al. ..... 148/536

* cited by examiner

*Primary Examiner*—George P Wyszomierski
(74) *Attorney, Agent, or Firm*—Ostrolenk, Faber, Gerb & Soffen, LLP

(57) ABSTRACT

A method for manufacturing a mesh screen of an electrodeless lighting system, capable of intercepting microwave and passing light generated in a bulb, including a mesh screen forming step for forming a mesh screen to have a mesh structure, a first plating step for plating first metal substance on the surface of the mesh screen, a vacuum heat-treating step for vacuum-heat-treating the mesh screen under the condition that the temperature is risen to a predetermined degree, a second plating step for plating second metal substance on the surface of the mesh screen and a photocatalytic coating step for coating photocatalytic substance on the surface of the mesh screen, can improve plating characteristic of the mesh screen, strengthen the maintenance strength, lengthen the life span of the mesh screen and improve the optical character.

21 Claims, 6 Drawing Sheets

METHOD FOR MANUFACTURING MESH SCREEN OF ELECTRODELESS LIGHTING SYSTEM

BACKGROUND OF THE INVENTION

1. Field of the Invention

The present invention relates to an electrodeless lighting system using microwave and particularly, to a method for manufacturing a mesh screen of an electrodeless lighting system, capable of intercepting microwave and passing light generated in a bulb.

2. Description of the Background Art

An electrodeless lighting system is a device for emitting visible rays or ultraviolet rays by applying microwave to an electrodeless lamp, and therefore, has longer life span than that of incandescent lamp or fluorescent lamp which is generally used, and has higher lighting effect.

FIG. 1 is a longitudinal cross-sectional view showing a general electrodeless lighting system according to the conventional art.

The conventional electrodeless lighting system includes a magnetron 1 for generating microwave, a waveguide 3 for guiding the microwave generated from the magnetron 1, A bulb 5 for generating light as the material enclosed is plasma polymerized by the energy of the microwave transmitted through the waveguide 3 and a mesh screen 20, covered on the front side of the waveguide 3 and bulb 5, for intercepting leakage of microwave and passing the light emitted from the bulb 5.

The electrodeless lighting system additionally includes a high voltage generator 7 for transforming utility AC power to high voltage, a cooling apparatus 9 for cooling the magnetron 1, high voltage generator 7 and the like, a reflector 11 for intensively reflecting the light generated from the bulb 5 and a bulb motor 13 and bulb shaft 15, for cooling heat generated in discharging light by rotating the bulb 5.

In the electrodeless lighting system, when a driving signal is inputted to the high voltage generator 7, the high voltage generator 7 transforms a utility AC power to high voltage from the outside and supplies the high voltage into the magnetron 1.

The magnetron 1 generates a microwave having very high frequency oscillating by the high voltage supplied from the high voltage generator 7 and the microwave generated as above is eradiated into the mesh screen 20 through the waveguide 3, then, the material filled in the bulb 5 is discharged to generate light having a very peculiar discharge spectrum.

The light generated in the bulb 5 is reflected on the reflector 11 and the light is illuminated frontward as reflected by a mirror 12 and the reflector 9.

FIG. 2 is a perspective view showing a mesh screen used in the above electrodeless lighting system and FIG. 3 is a detail view showing "A" portion in FIG. 2.

With reference to FIG. 1, the mesh screen 20 formed in a metal mesh is assembled at the outlet portion 3*a* of the waveguide 3, intercepts the microwave transmitted through the waveguide 3 so that the microwave energy is transformed to be light in the bulb 5 and at the same time intercepts leakage of the microwave to the outside so that the light generated in the bulb 5 is penetrated to the outside.

With reference to FIGS. 2 and 3, such mesh screen includes a cylindrical part 21 where a plurality of holes 20*b* are formed except in a part at an opened part 20*a* by the etching processing and a cover part 25 formed in a convex shape, where a plurality of holes 20*b* are formed to be connected to the from portion of the cylindrical part 21 by the etching processing.

Here, the cylindrical part 21 includes a mesh portion 22 for intercepting microwave and passing light and a non-mesh portion 23 which is not etching processed to be fixed to the outlet part of the waveguide 3.

Such mesh screen 20 must be formed precisely, penetrate light emitted from the bulb 5 well and have heat resistance so that it can resist against heat generated from the bulb 5, since it intercepts leakage of the microwave forming a resonance region.

Here, the method for manufacturing such mesh screen 20 in accordance with the conventional art will be described with reference to FIG. 4.

Base metal is formed by cutting a metal thin film with a predetermined thickness made of stainless steel or phosphor bronze in the square shape or circular shape.

Holes having the mesh structure are formed by etching with solutions such as FeCl2 and the like to form a mesh structure on the base metal.

Here, it is desirable that the holes formed by etching on the metal thin film are formed with a size, capable of intercepting leakage of the microwave to the outside having the highest opening rate so that the light emitted from the bulb 5 in FIG. 1 is radiated to the outside as much as possible.

When the mesh structure is formed in the base metal, the cylindrical part 21 is manufactured by welding the metal to have a cylindrical shape as in FIG. 2 and then a mesh screen 20 with a side opened is formed by assembling by the method such as welding and the like.

Then, electric resistance of the surface is decreased as the light reflectivity of the surface of the mesh screen 20 becomes higher and the mesh screen is completed by plating as a three-step structure, performing the Ni plating process for plating Ni on the mesh screen 20 to improve heat resistance, Ag plating process for plating Ag and the Rh plating processing for plating Rh.

However, the mesh screen manufactured by the method for manufacturing the mesh screen in accordance with the conventional art, causes deformation of plated layers as residuals are evaporated at high temperature, if the mesh screen is exposed to the high temperature over 1000° C. due to heat generated from the bulb 5, since various organic materials or acid radicals are remained when the plate of the mesh screen 20 is plated.

Also, separation between plated layers is occurred when the mesh screen 20 at high temperature is given thermal stress.

Therefore, in case the mesh screen is manufactured in the conventional manufacturing method, deformation or separation of the plated layer is occurred and discoloration or oxidation corrosion is accelerated when the mesh screen 20 is contacted with external air in the air cooling structure, thus to decrease security of the mesh screen 20 and shorten the life span.

SUMMARY OF THE INVENTION

Therefore, an object of the present invention is to provide a method for manufacturing a mesh screen of an electrodeless lighting system, capable of improving the security of the mesh screen and lengthening the life span of the mesh screen by performing vacuum heat-treating process in the plating process of the mesh screen to improve heat resistant characteristic and chemical resistant characteristic.

Another object of the present invention is to provide a method for manufacturing a mesh screen of an electrodeless lighting system, capable of improving optical character by endowing a self-clarifying function by plating the mesh screen and then coating photocatalytic substance.

To achieve these and other advantages and in accordance with the purpose of the present invention, as embodied and broadly described herein, there is provided a method for manufacturing a mesh screen of an electrodeless lighting system, including a mesh screen forming step for forming a mesh screen to have a mesh structure, a first plating step for plating first metal substance on the surface of the mesh screen, a vacuum heat-treating step for vacuum-heat-treating the mesh screen under the condition that the temperature is risen to a predetermined degree, a second plating step for plating second metal substance on the surface of the mesh screen and a photocatalytic coating step for coating photocatalytic substance on the surface of the mesh screen.

The first metal substance is Ni and the second metal substance is Ag.

The vacuum degree is 10–7E Torr in the vacuum heat-treating step and the heat-treating is performed raising the heating temperature up to 700° C.

Namely, the vacuum heat-treating step includes a temperature raising process for raising the temperature of the mesh screen from the room temperature to 650° C., a holding process for vacuum-heat-treating the mesh screen at 650° C. for a predetermined time, a coercive cooling process for coercively cooling the mesh screen and a natural cooling process for naturally cooling the mesh screen to room temperature.

The photocatalytic substance is an oxidized substance containing $TiO_2$.

Also, the method for manufacturing the mesh screen of the electrodeless lighting system includes a first plating step for plating first metal substance on the surface of the mesh screen, a vacuum heat-treating step for vacuum-heat-treating the mesh screen under the condition that the temperature is risen up to 700° C. and a second plating step for plating second metal substance on the surface of the mesh screen.

Also, the method for manufacturing the mesh screen of the electrodeless lighting system includes a mesh screen forming step for forming a mesh screen to have a mesh structure, a plating step for plating metal substance on the surface of the plated mesh screen and a photocatalytic coating step for coating photocatalytic substance on the surface of the mesh screen.

The foregoing and other, features, aspects and advantages of the present invention will become more apparent from the following detailed description when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, the embodiments of the present invention will be described with reference to the accompanied drawings as follows.

Figure 1:
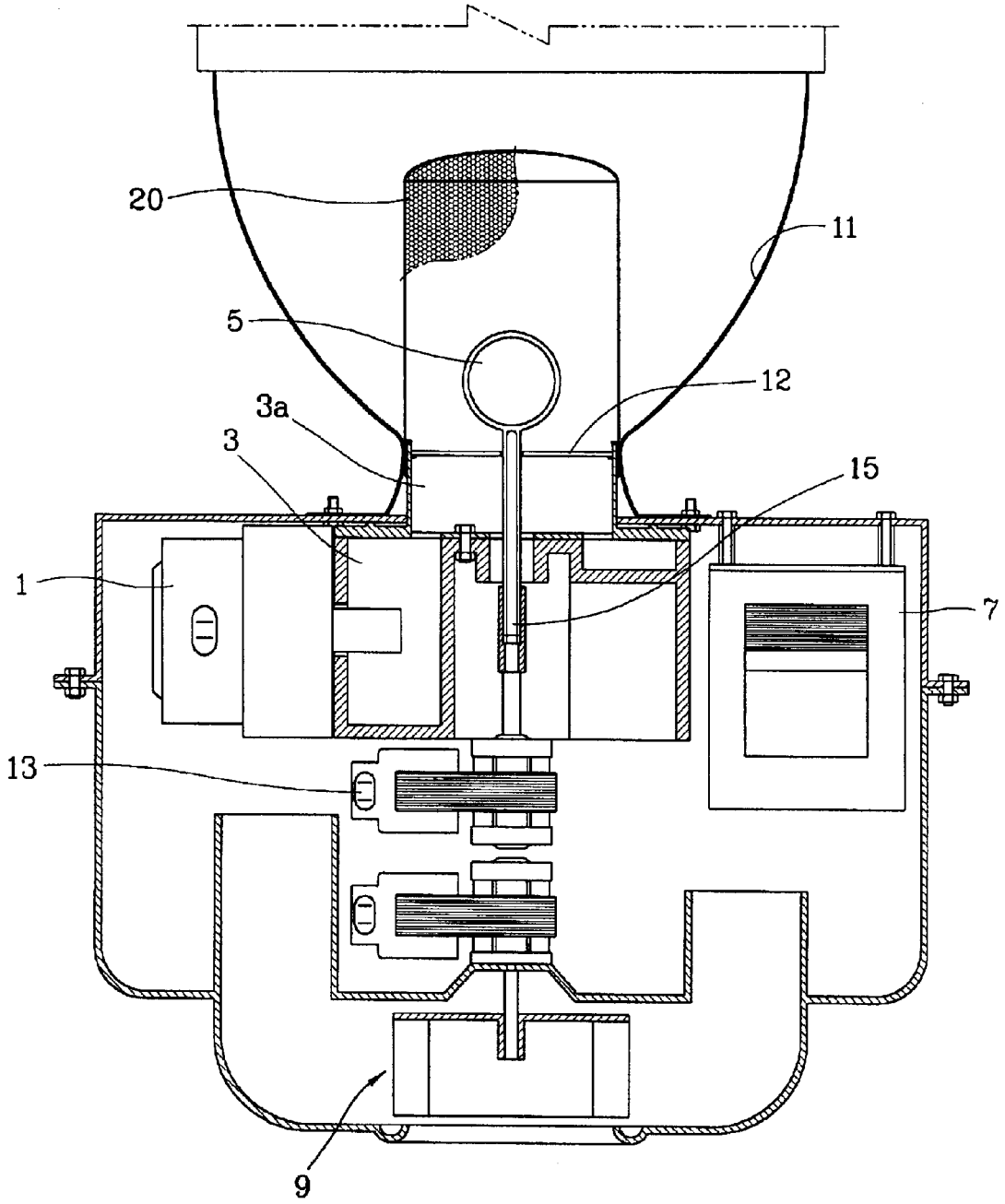
FIG. 1 is a longitudinal cross-sectional view showing a general electrodeless lighting system according to the conventional art.
Figure 2:
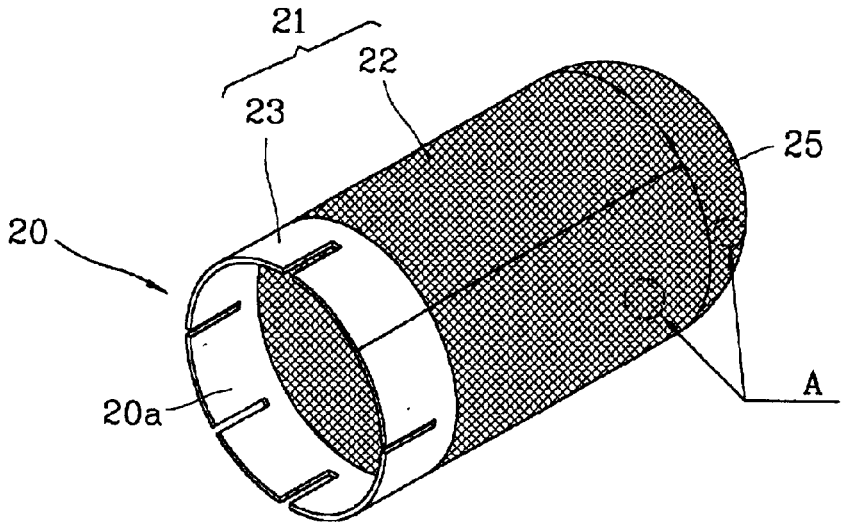
FIG. 2 is a perspective view showing a mesh screen in FIG. 1.
Figure 3:
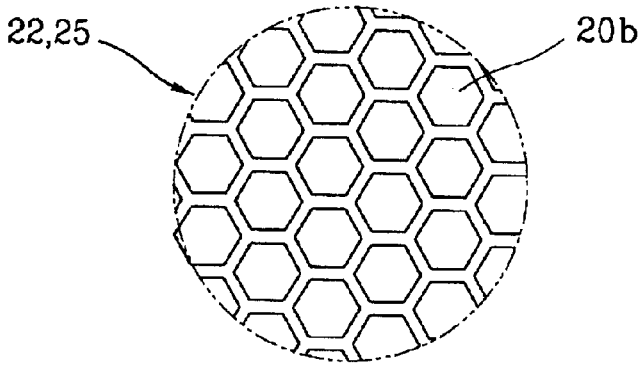
FIG. 3 is a detail view showing "A" portion in FIG. 2.
Figure 4:
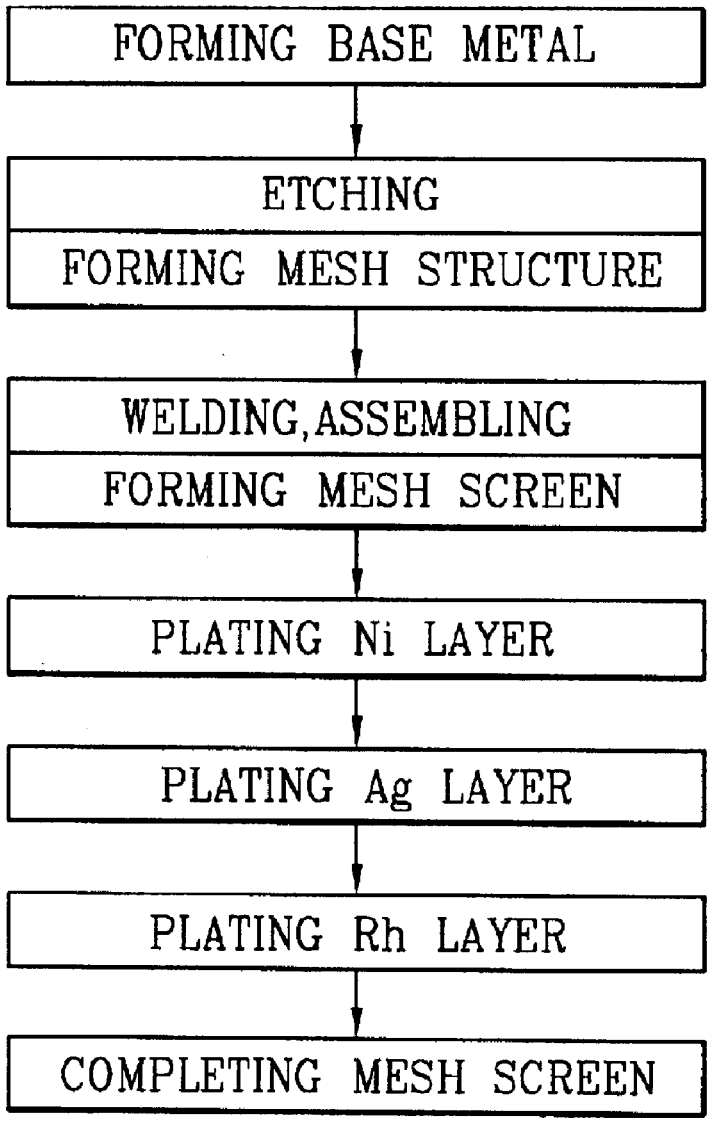
FIG. 4 is a flow chart showing a method for manufacturing a mesh screen of the electrodeless lighting system according to the conventional art.
Figure 5:
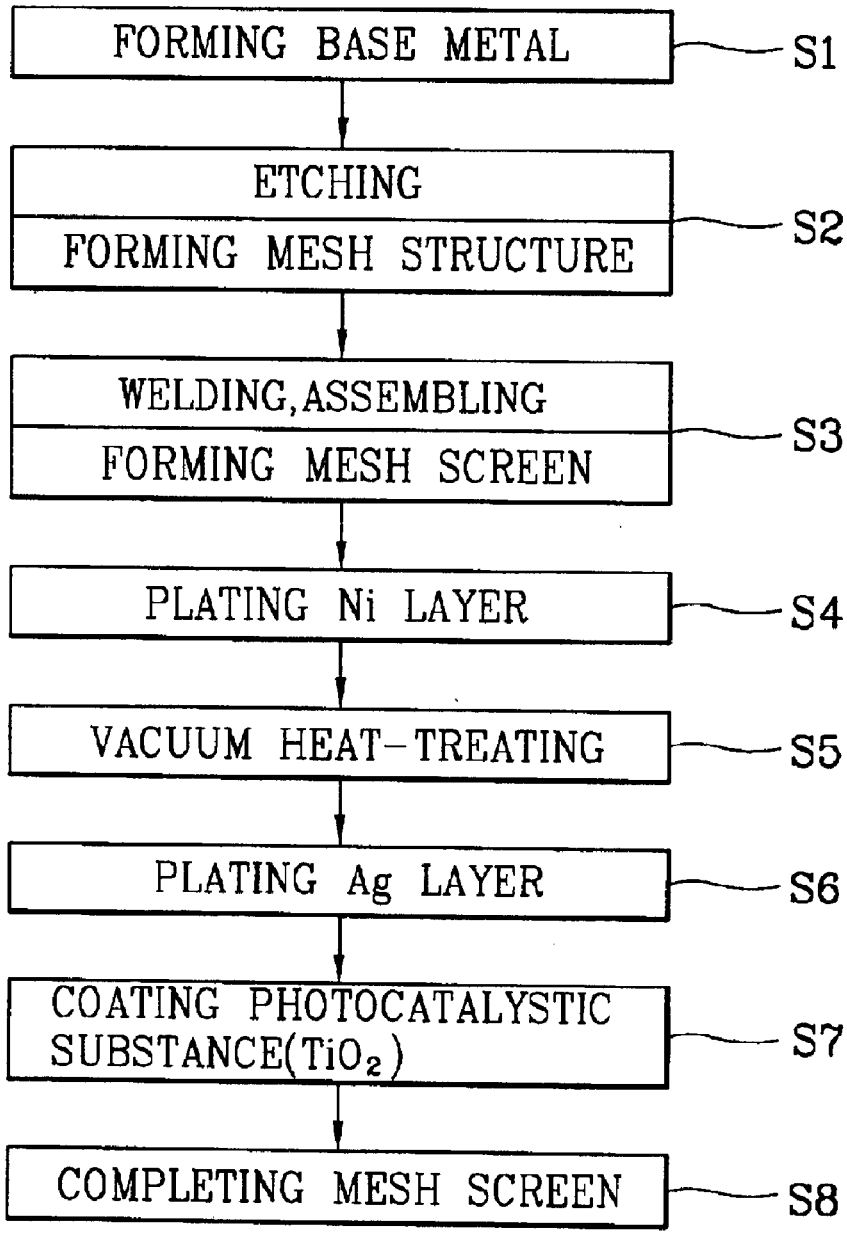
FIG. 5 is a flow chart showing a method for manufacturing a mesh screen of the electrodeless lighting system in accordance with an embodiment of the present invention.
Figure 6:
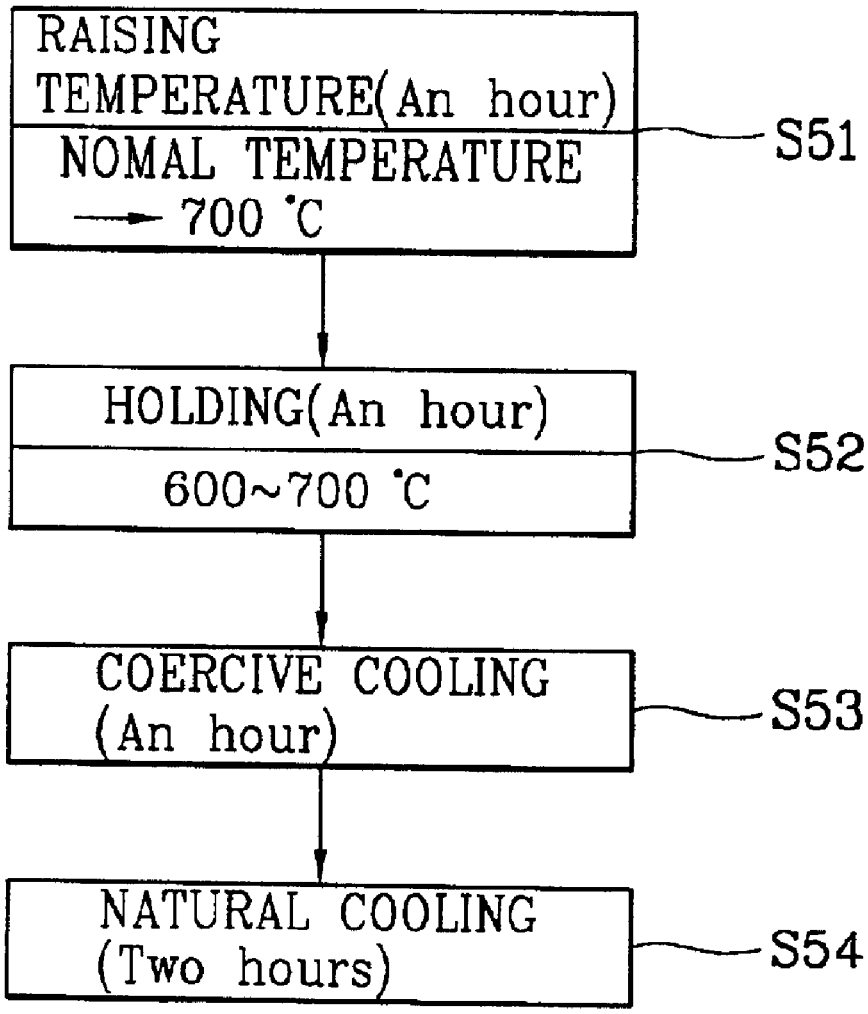
FIG. 6 is a flow chart showing a vacuum heat-treating method in the method for manufacturing the mesh screen in accordance with an embodiment of the present invention.

FIG. 5 is a flow chart showing a method for manufacturing a mesh screen of an electrodeless lighting system in accordance with an embodiment of the present invention and FIG. 6 is a flow chart showing a vacuum heat-treating method in the method for manufacturing the mesh screen in accordance with an embodiment of the present invention.

The method for manufacturing the mesh screen of the electrodeless lighting system in accordance with the present invention, as shown in FIG. 5, includes a base metal forming step $S_1$ for forming base metals by cutting the metal thin film with a predetermined thickness respectively in the square shape and circular shape, a mesh forming step $S_2$ for forming holes having the mesh structure by etching to forming the mesh structure in the base metal, mesh screen forming step $S_3$ for forming a mesh screen with an end opened, by assembling a cover part 25 in a cylindrical part 21 after manufacturing the cylindrical part 21 when the mesh structure is formed, a first plating step $S_4$ for plating Ni on the surface of the mesh screen, a vacuum heat-treating step $S_5$ for vacuum-heat-treating the mesh screen at high temperature up to 700° C., a second plating step $S_6$ for plating Ag on the surface of the mesh screen and a photocatalytic coating step $S_7$ for coating photocatalytic substance on the mesh screen.

The process of each step will be described as follows.

First, the material of the metal thin film is composed of stainless steel group or phosphor bronze in the base metal forming step $S_1$ and the base metal for forming the mesh screen is processed, being cut in the square shape for forming the cylindrical part 21 and the circular shape for forming the cover part 25.

Then, the mesh forming step $S_2$ is a step for forming the mesh structure having a plurality of holes in the base metal manufactured in the base metal forming step $S_1$ and the mesh structure is formed by etching the base metals with $FeCl_2$. At this time, the holes forming the mesh structure are formed uniformly at a certain interval without a clogged portion.

In the mesh screen forming step $S_3$, the square thin film where the mesh structure is formed in the step $S_2$ is welded in a cylindrical shape. After manufacturing the cylindrical part 21, the circular cover part 25 where the mesh structure is formed is welded-assembled on an opened surface of the cylindrical part 21. Therefore, a mesh screen with just a side opened is formed.

Then, in the first coating step $S_4$, metal substance, Ni is plated on the surface of the mesh screen manufactured in the above step $S_3$ to improve plating adhesiveness and corrosion resistance.

Then, in the vacuum heat-treating step $S_5$, since impurities and dissolved gas can exist in the plated layer plated on the surface of the mesh screen in the above step $S_4$, residuals such as the impurities, dissolved gas and the like are removed by heat-treating the mesh screen with high temperature about 400° C. to 700° C. in a vacuum furnace where there is no gas reaction, thus to increase cohesion force between the surface of the mesh screen and Ni-plated layer and restrain reaction such as oxidization or decarbonization.

As shown in FIG. 6, the vacuum heat-treating step includes a temperature raising process $S_{51}$ for inputting the mesh screen in the plated vacuum furnace and raising the temperature of the mesh screen from the room temperature to 700° C. for an hour, maintaining vacuum degree as 10−7E Torr, a holding process $S_{52}$ for vacuum-heat-treating the mesh screen from 600° C. to 700° C. for about an hour, a coercive cooling process $S_{53}$ for coercively cooling the mesh screen for about an hour and a natural cooling process $S_{54}$ for naturally cooling the mesh screen to room temperature for about two hours.

Here, in the holding process $S_{52}$, impurities are removed by heat-treating the mesh screen in the vacuum furnace for thirty minutes to an hour, maintaining the temperature region of 600° C. to 700° C.

By vacuum heat-treating the mesh screen plated by Ni, as atomic diffusion is occurred through the interface from the Ni-plated layer to the mesh screen made of stainless steel, cohesion force between the plated layer and the mesh screen is increased and the Ni-plated layer is stabilized by burning out various organic materials having high acid radical and vapor pressure, generated in the etching and plating processes. Also, as the layer is strengthened by the vacuum heat treatment, heat deformation of the mesh screen is minimized so that the shape of the mesh structure is maintained as the initial designation size accurately.

Also, Ni, which is a ferromagnetic body, loses magnetism at higher temperature than 360° C. and accordingly, since it is heated to higher temperature than 400° C., magnetism of the Ni-plated layer is removed.

Then, in the second plating step $S_6$, Ag is plated on the surface of the nickel plating on the mesh screen vacuum-heated in the above step $S_5$ to increase translucency of light and electric conductivity of the surface.

At this time, metal either Pt or Pt group can be used to be plated, instead of Ag.

Then, in the photocatalytic coating step $S_7$, photocatalytic function is added by coating oxidized material containing $TiO_2$ on the surface of the mesh screen coated by Ag in the above step $S_6$.

Here, the photocatalyst is activated when the catalyst faces light. Namely, when light is irradiated to the photocatalyst, the catalyst receives light energy, electrons move in the catalyst and the moved electrons cause chemical reactions such as strong oxidization, deoxidization and the like. At this time, the strong chemical reaction of the moved electrons oxidize contaminants around the mesh screen to be harmless substance.

In the above, the photocatalytic substance composed of oxidized material containing $TiO_2$ generates a photocatalytic phenomenon by wavelength range of 380 nm or the lower among optical spectrum from the bulb.

On the other hand, $TiO_2$ photocatalyst is an n-type semiconductor and when ultraviolet ray (400 nm or the lower) is irradiated, hydroxy radical (*OH) and $O_2^-$ having a strong oxidizing power are generated due to formation of the electron and hole. The oxidizing power dissolves the organic material into $CO_2$ and water, thus to remove contaminants, preserve from decay and sterilization and deodorize in the water and air.

Therefore, when the light generated in the bulb of the electrodeless lighting system is irradiated on the mesh screen coated by the photocatalytic substance, photocatalytic phenomenon that the photocatalytic substance is activated is occurred, thus to clarify various harmful gases or contaminants flown around the mesh screen from the outside.

Through the above manufacturing method, the operation of the mesh screen will be described as follows.

The mesh screen in accordance with the present invention can achieve chemical stability by removing acid radical, organic material and impurities generated in the etching process and nickel plating process, in the vacuum heat-treating process and accordingly, the mesh screen is not easily deformed or burned out in operating the lighting system under the condition of high temperature.

Also, in the vacuum heat-treating process, since only interface of the Ni-plated layer is diffused to the mesh screen, joining force of the plated layer of stainless steel and Ni which are main materials of the mesh screen and high temperature stability can be achieved.

Also, the mesh screen is strengthened by the vacuum heat treatment, deformation is minimized under the condition of high temperature and accordingly, the initial performance for intercepting microwave can be maintained for a long time.

On the other hand, the mesh screen of the present invention increases translucency of the light generated in the bulb and improves the conductivity, since the mesh screen is coated by Ni and then coated by Ag on the surface, and the heat generated in the mesh screen can be transmitted to the outside, thus to prevent a partial overheating phenomenon.

Also, the mesh screen in accordance with the present invention can self-control various harmful gases or contaminants around the mesh screen and improve optical character passing the mesh screen, in using the lighting system since photocatalytic coating is formed on the mesh screen.

Figure 7:
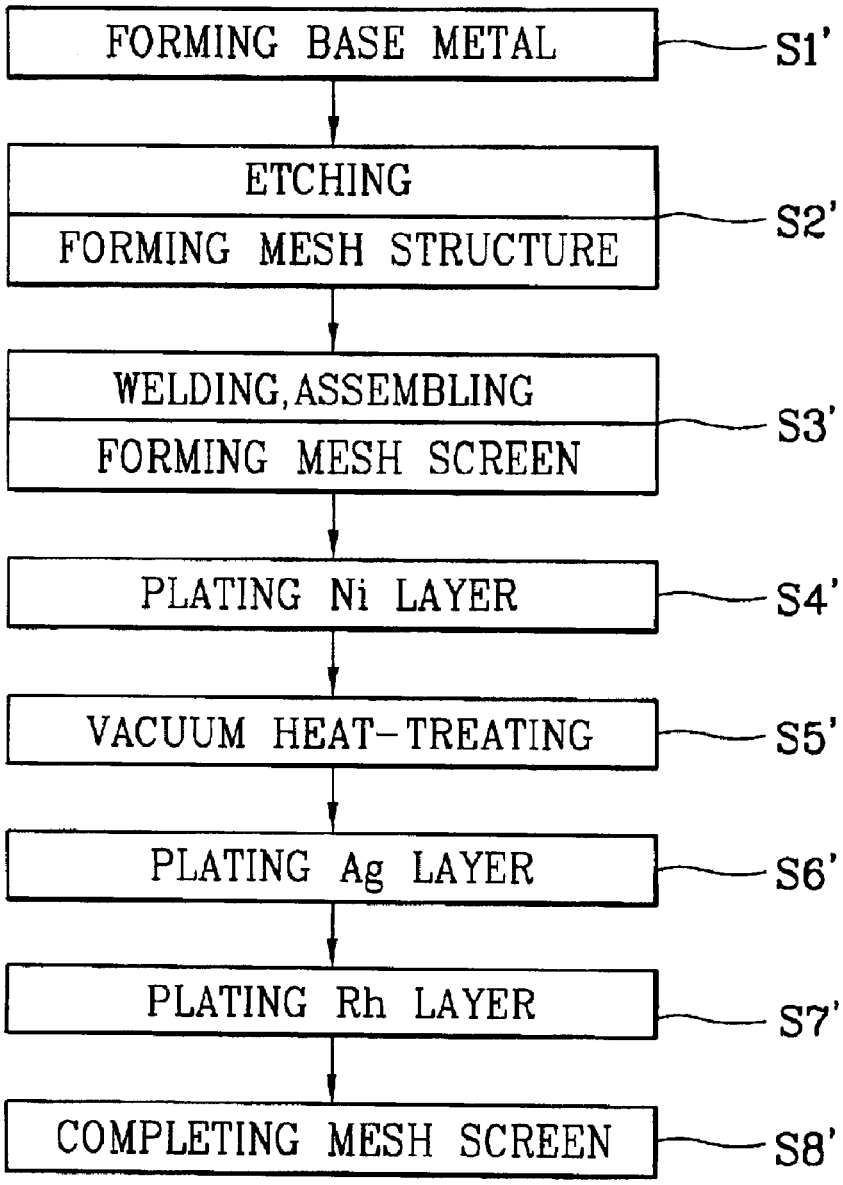
FIG. 7 is a flow chart showing the method for manufacturing the mesh is screen in accordance with another embodiment of the present invention.

FIG. 7 is a flow chart showing the method for manufacturing the mesh screen in accordance with another embodiment of the present invention.

The method for manufacturing the mesh screen in accordance with another embodiment of the present invention includes a base metal forming step $S_1'$ for forming base metals by cutting the metal thin film with a predetermined thickness respectively in the square shape and circular shape, a mesh forming step $S_2'$ for forming holes having the mesh structure by etching to forming the mesh structure in the base metal, mesh screen forming step $S_3'$ for forming a mesh screen with an end opened, by assembling a cover part 25 in a cylindrical part 21 after manufacturing the cylindrical part 21 when the mesh structure is formed, a first plating step $S_4'$ for plating Ni on the surface of the mesh screen, a vacuum heat-treating step $S_5'$ for vacuum-heat-treating the mesh screen at high temperature up to 700° C., a second plating step $S_6'$ for plating Ag on the surface of the mesh screen and a photocatalytic coating step $S_7'$ for coating Rh on the mesh screen.

Here, when Ag is coated on the Ag-coated surface of the mesh screen, stability of the Ag coated layer is increased.

On the other hand, a photocatalytic coating step for coating photocatalytic substance on the surface of the mesh screen can be included as described in the above embodiment, after coating Rh on the surface of the mesh screen.

With the method for manufacturing the mesh screen of the electrodeless lighting system in accordance with the present invention, plating characteristic of the mesh screen can be improved and maintenance strength can be strengthened. Also, by endowing the clarifying function, the present invention can lengthen the life span of the mesh screen and improve the optical character.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A method for manufacturing a mesh screen of an electrodeless lighting system, comprising:

a mesh screen forming step for forming a mesh screen to have a mesh structure;

a first plating step for plating first metal substance on the surface of the mesh screen;

a vacuum heat-treating step for vacuum-heat-treating the mesh screen under the condition that the temperature is risen to a predetermined degree;

a second plating step for plating second metal substance on the surface of the mesh screen; and a photocatalytic coating step for coating photocatalytic substance on the surface of the mesh screen.

2. The method of claim 1, wherein the mesh screen forming step forms the mesh screen to have the mesh structure by etching processing.

3. The method of claim 1, wherein the first metal substance is Ni.

4. The method of claim 1, wherein the second metal substance is Ag.

5. The method of claim 1, wherein the vacuum degree is 10−7E Torr in the vacuum heat-treating step.

6. The method of claim 1, wherein the heat-treating is performed raising the heating temperature to 700° C.

7. The method of claim 1, wherein the vacuum heat-treating step is performed for 30 minutes to an hour in the temperature area from 600° C. to 700° C.

8. The method of claim 1, wherein the vacuum heat-treating step includes:

a temperature raising process for raising the temperature of the mesh screen from the room temperature to 650° C.;

a holding process for vacuum-heat-treating the mesh screen at 650° C. for a predetermined time;

a coercive cooling process for coercively cooling the mesh screen; and a natural cooling process for naturally cooling the mesh screen to room temperature.

9. The method of claim 8, wherein the temperature raising process, a holding process and the coercive cooling process are respectively performed for an hour and the natural cooling process is performed for two hours.

10. The method of claim 1, wherein the photocatalytic substance is an oxidized substance containing $TiO_2$.

11. A method for manufacturing a mesh screen of an electrodeless lighting system, comprising:

a first plating step for plating a first metal substance on the surface of the mesh screen;

a vacuum heat-treating step for vacuum-heat-treating the mesh screen under the condition that the temperature is raised to 700° C.;

a second plating step for plating a second metal substance on the surface of the mesh screen, wherein the second metal substance is constituted of thermal conductive material; and a third plating step for plating a third metal substance on the surface of the mesh screen after the second plating step.

12. The method of claim 11, wherein the first metal substance is Ni and the second metal substance is Ag.

13. The method of claim 11, wherein the third metal substance is Rh.

14. The method of claim 11, wherein the vacuum heat-treating step includes:

a temperature raising process for raising the temperature of the mesh screen from the room temperature to 650° C.;

a holding process for vacuum-heat-treating the mesh screen at 650° C. for a predetermined time;

a coercive cooling process for coercively cooling the mesh screen; and a natural cooling process for naturally cooling the mesh screen to room temperature.

15. The method of claim 14, wherein the temperature raising process, a holding process and the coercive cooling process are respectively performed for an hour and the natural cooling process is performed for two hours.

16. A method for manufacturing a mesh screen of an electrodeless lighting system, comprising:

a mesh screen forming step for forming a mesh screen to have a mesh structure;

a plating step for plating metal substance on the surface of the plated mesh screen; and a photocatalytic coating step for coating photocatalytic substance on the surface of the mesh screen.

17. The method of claim 16, wherein the metal substance is Ni.

18. The method of claim 16, wherein the metal substance is Ag.

19. The method of claim 16, wherein the photocatalytic substance is an oxidized substance containing $TiO_2$.

20. A method for manufacturing a mesh screen of an electrodeless lighting system, comprising:

a first plating step for plating Ni on the surface of the mesh screen;

a vacuum heat-treating step for vacuum-heat-treating the mesh screen under the condition that the temperature is raised to 700° C.; and a second plating step for plating Ag on the surface of the mesh screen.

21. The method of claim 20, further comprising a third plating step for plating Rh on the surface of the mesh screen after the second plating step.

* * * * *